United States Patent [19]

Kjellberg

[11] 4,317,972

[45] Mar. 2, 1982

[54] RF TRANSFER SWITCH

[75] Inventor: Evert Kjellberg, Los Angeles, Calif.

[73] Assignee: Transco Products, Inc., Venice, Calif.

[21] Appl. No.: 157,397

[22] Filed: Jun. 9, 1980

[51] Int. Cl.[3] ..... H01H 1/20

[52] U.S. Cl. ..... 200/153 S; 200/243; 200/16 A

[58] Field of Search ..... 200/16 A, 153 S, 243, 200/51.4, 51.5, 51.6, 51.7; 333/105

[56] References Cited

U.S. PATENT DOCUMENTS

| | | | |
|---|---|---|---|
| 2,697,767 | 12/1954 | Charles | 200/153 S |
| 2,926,318 | 2/1960 | Lanctot | 200/153 S |
| 3,141,943 | 7/1964 | Lanctot | 200/153 S |
| 3,739,306 | 6/1973 | Sladek | 200/153 S |
| 4,187,416 | 2/1980 | Caro | 200/153 S |

*Primary Examiner*—John W. Shepperd
*Attorney, Agent, or Firm*—Charles H. Schwartz; Ellsworth R. Roston

[57] ABSTRACT

A transfer switch for providing transfer of electrical signals between pairs of connectors in an array of four connectors, including a transfer structure disposed in a particular plane and formed by a plurality of transfer paths and including an outer circumferential portion formed by three linked portions and three radial portions each extending from a central position within the circumferential portion and each radial portion extending outwardly and intersecting the circumferential portion of the juncture of two linked portions, four connectors coupled to the transfer structure and with individual connectors coupled to the transfer structure at each intersection between a radial portion and two linked portions and with an individual connector coupled to the central position, and a plurality of transfer means individually coupled to the individual transfer paths and with each transfer means including a first position for preventing transfer of electrical signals between a pair of connectors and a second position for effecting a transfer of electrical signals between a pair of connectors.

12 Claims, 11 Drawing Figures

Fig. 1
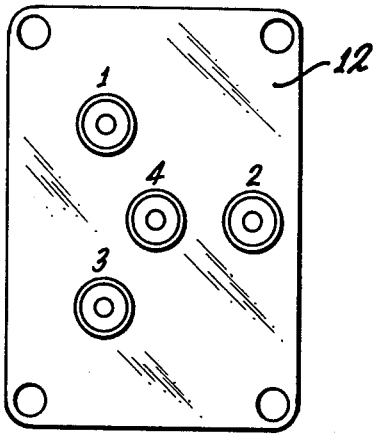
Fig. 2
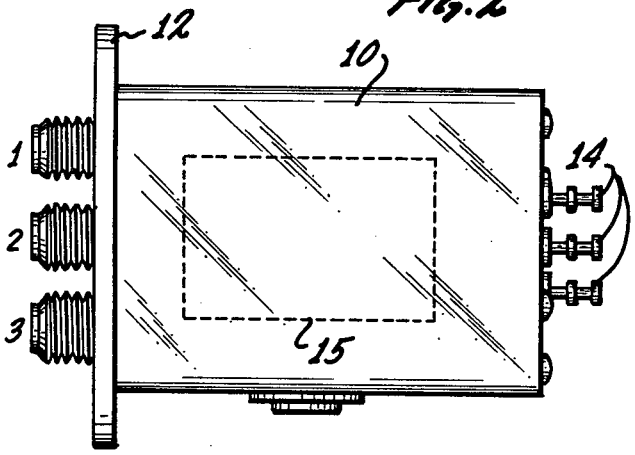
Fig. 3
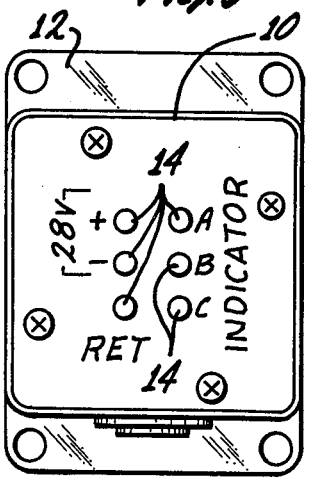
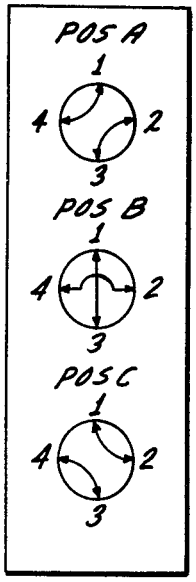
Fig. 4

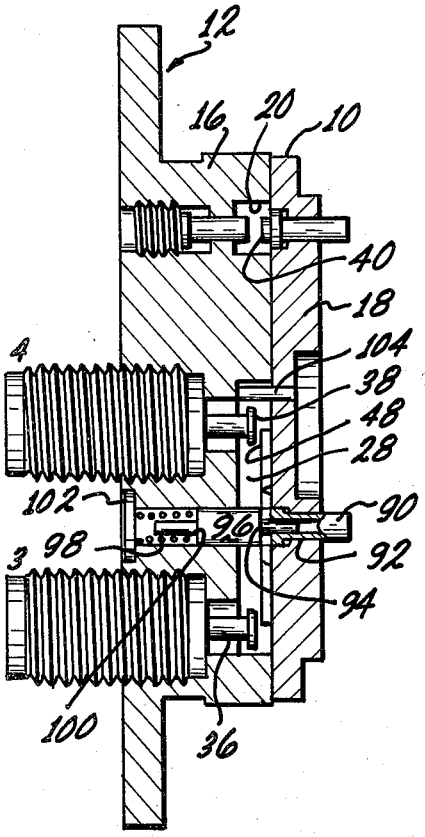
FIG. 6
FIG. 8
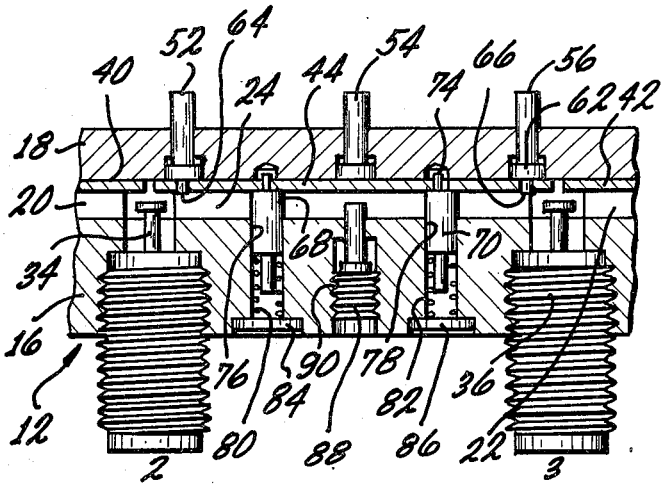
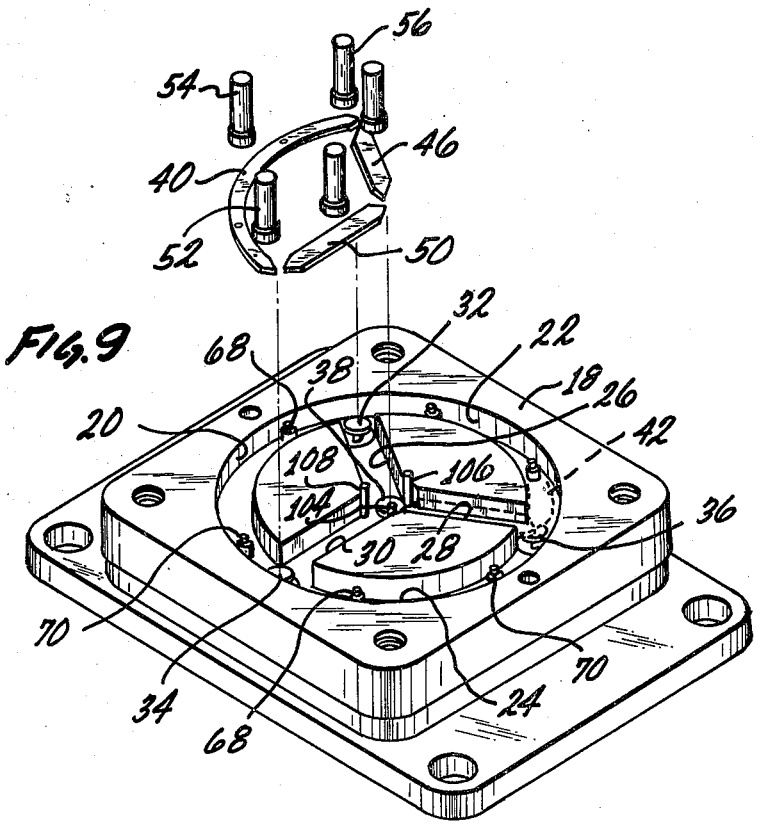
FIG. 9

RF TRANSFER SWITCH

The present invention relates to a transfer switch for providing transfer of electrical signals between pairs of connectors. Specifically, the present invention may be a RF switch such as a coaxial switch for providing for a transfer of RF signals between coaxial connectors.

Generally, RF switches currently in use have one of three configurations. A first configuration is a single pole double throw switch for providing for a signal at an input connector being switched to one of two output connectors. A second configuration is a multi-position switch which provides for a signal applied to a first input connector being switched to any one of a plurality of output connectors and with three or more such output connectors.

A third configuration for a RF switch is a transfer switch and typically includes four connectors for RF signals. In the transfer type of RF switch the switching is accomplished between pairs of connectors such that in one position signals may be transferred between first and second connectors and between third and fourth connectors. In another position of the transfer switch, the signals may be transferred between the first and third connectors and the second and fourth connectors. It would also be desirable to have the transfer switch provide for a third position where the signals are transferred between the first and fourth connectors and the second and third connectors.

Generally in the prior art the RF transfer switches only provide for two positions. There have been attempts to provide for a three position RF transfer switch but the prior art three position RF transfer switches are generally complicated and have switching components located in more than a single plane so that at least two of the switching elements overlay each other. The use of switching elements which overlay each other increases the complexity of the switching structure and as indicated above, forces the switching structure to be in more than a single plane. In addition, when the switching elements overlay each other, there is always the danger of cross-talk between the overlaying elements and such cross-talk, of course, is undesirable.

The present invention provides for an RF transfer switch which provides for three transfer positions between pairs of four connectors and wherein all of the switching elements lie in the same plane and none of the switching elements overlay each other. In a particular embodiment of the RF transfer switch of the present invention, the switch is formed as a coaxial switch and with the switching elements provided as flat line segments which either lie against or are disposed in the middle of cavity portions. When the line segment lies against the wall of the cavity portion, it is shorted to the cavity and is also out of connection with the inner conductors of the coaxial connector. When the line segment is positioned to the center of the cavity portion, the ends of the line segment also contact the inner conductors of the coaxial connectors since the inner conductors are positioned adjacent the ends of the line segment.

In the present invention a RF cavity is disposed in a particular plane and is formed to have a plurality of cavity portions. Specifically, the cavity has an outer circumferential portion which is subdivided into three outer cavity portions. Three radial cavity portions extend from a central position within the circumferential portion and intersect the ends of the three outer cavity portions. A first coaxial connector is positioned at the central position and three additional coaxial connectors are positioned at the intersections between the radial cavity portions and the outer cavity portions. All of the portions of the cavity are disposed within the same plane and the ends of the inner conductors of the coaxial connectors are also disposed within the same plane.

An individual line segment is positioned within each cavity portion and is movable between a position against the wall of the cavity and away from the inner conductors and a central position within the cavity portion and in contact with the inner conductor. There are a total of six line segments which correspond to the six cavity portions. The configuration of the line segments also correspond to that of the cavity portions so that three line segments are radially disposed from a central position and radiate outward and three line segments are disposed around the three radial members to form a circumferential segment.

The various line segments may be individually actuated so that signals are transferred between pairs of coaxial connectors. By proper actuation three different pairs of transfer positions are provided so as to provide for all possible pairs of interconnections between the four coaxial connectors. The structure of the present invention allows for complete redundancy in the switching and thereby multiplies the usefulness of the coaxial switch.

A clearer understanding of the present invention will be had with reference to the following description and drawings wherein:

FIG. 1 illustrates one end view of a complete RF transfer switch illustrating the spatial positions of four coaxial connectors;

FIG. 2 illustrates a side view of the RF switch of FIG. 1 showing the coaxial connectors at one end and power and control terminals at the other end;

FIG. 3 illustrates the other end of the RF switch of FIG. 1 illustrating the spatial positions of the control and power terminals;

FIG. 4 is a schematic of the three positions for the switch of the present invention;

FIG. 6 is a cross-sectional view taken along lines 6—6 of FIG. 5;

FIG. 8 is a cross-sectional view taken along lines 8—8 of FIG. 7;

FIG. 9 illustrates the cavity portion and shows the interrelationship between the cavity portions and the line segments;

Figure 5:
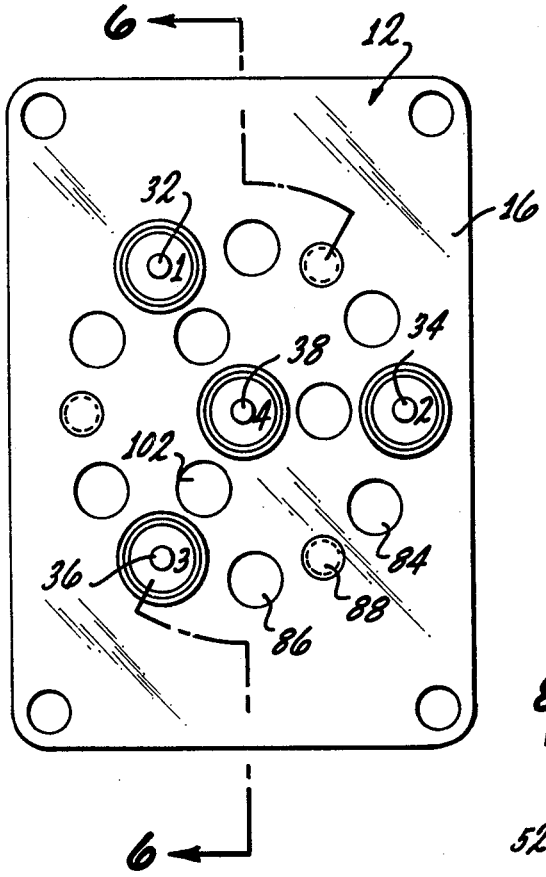
FIG. 5 illustrates the one end of the cavity portion of the RF switch of the present invention.

FIGS. 1, 2 and 3 illustrate the outer configuration of the RF switch of the present invention. Specifically, the RF switch includes an outer casing 10 which encloses the various switch components. Specifically, a cavity portion 12 is mounted at one end of the switch and internal to the housing 10 are actuator components shown generally by dotted portion 15. The cavity portion 12 includes a plurality of coaxial connectors designated as connectors 1, 2, 3 and 4. As can be seen in FIG. 1, connector 4 is centrally located and with connectors 1, 2 and 3 positioned around connector 4 and equidistant from connector 4. Also, connectors 1, 2 and 3 are positioned at approximately 120° from each other using connector 4 as a central axis position.

The other end of the RF switch includes a plurality of terminals 14 which, as shown in FIG. 3, are designated by the letters A, B and C and by a plus (+) and a minus (−) and a signal return (RET). Terminals 14 are used to supply control and power inputs to the RF switch to produce transfer switching between signals coupled between pairs of the coaxial connectors 1, 2, 3 and 4. Specifically, the control actuator generally designated 15 in FIG. 2 may be an electromagnetic type of actuator and with the plus (+) and minus (−) terminals receiving a source of power for the actuator. The terminals designated A, B and C may receive control signals to provide for three different transfer positions for the RF signals coupled between pairs of the coaxial connectors. The return terminal (RET) is a common return for all of the control signals.

Referring to FIG. 4, the control signals impressed on the terminals designated A, B and C may represent the three switching positions shown in FIG. 4. Specifically, if a control signal is provided at terminal A, a position A may produce an internal switching so that coaxial connectors 1 and 4 are interconnected as are coaxial connectors 2 and 3. A control signal impressed on terminal B provides for a position B wherein coaxial connectors 1 and 3 are interconnected as are coaxial connectors 2 and 4. Finally, a control signal impressed on terminal C provides for a position C wherein coaxial connectors 1 and 2 are interconnected as are coaxial connectors 3 and 4. It can be seen that all possible interconnections of pairs of the four coaxial connectors are produced by the three positions shown in FIG. 4.

FIGS. 6 through 9 illustrate the cavity portion 12 of the present invention in more detail. As can be seen, the cavity portion 12 is formed from a pair of plate members 16 and 18. The plate member 16 includes a plurality of recessed portions which form the body of the cavity and plate member 18 serves as a cover member to enclose the recessed portions to form the complete cavity composed of the various cavity portions.

Figure 7:
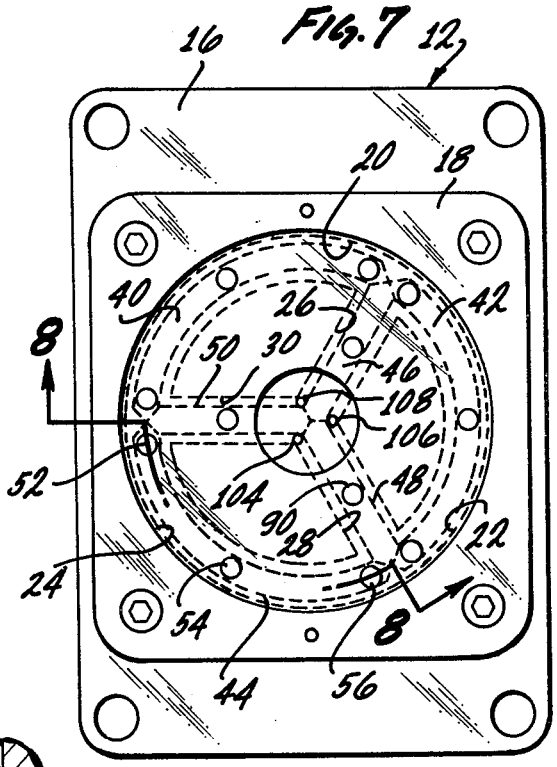
FIG. 7 is the other end of the cavity portion of the RF switch.

Specifically, as shown in FIGS. 7 and 9, the cavity includes a plurality of outer arcuate portions 20, 22, and 24 which together form a circumferential portion and radial portions 26, 28 and 30 which extend from a central position and intersect the circumferential portion. The three outer portions 20, 22 and 24 are actually formed as a continuous circumferential path and with the ends of these outer cavity portions defined by the intersections with the radial portions 26, 28 and 30.

The coaxial connectors 1, 2, 3 and 4 extend through the plate member 16 and are mounted in positions which correspond to the intersections between the cavity portions. Specifically, coaxial connector 1 is mounted to have its inner conductor 32 located at the intersection between the cavity portions 20, 22 and 26. The coaxial connector 2 is mounted to have its inner conductor 34 mounted at the intersection of cavity portions 20, 24 and 30. Coaxial connector 3 is mounted to have its inner conductor 36 located at the intersection of cavity portions 22, 24 and 28. The coaxial connector 4 is located intermediate the connectors 1, 2 and 3 and connector 4 is mounted to have its inner conductor 38 located at the intersection of the three radial cavity portions 26, 28 and 30.

In order to provide for interconnection between pairs of coaxial connectors, a plurality of line segments are provided to correspond to the plurality of cavity portions. Specifically, line segments 40, 42 and 44 are located within and conform to the arcuate configuration of the outer cavity portions 20, 22 and 24. Radial line segments 46, 48 and 50 lie within and conform to the radial cavity portions 26, 28 and 30. As can be seen in FIGS. 7 and 9 the ends of the various line segments are shaped so that the ends of the line segments can contact an inner conductor of a coaxial connector when desired, yet with the ends free of each other so that the ends will not interfere with the movement of an adjacent line segment.

All of the cavity portions and line segments are therefore disposed within a particular plane and none of the cavity portions or line segments overlap each other. In this way, the cavity may be simply formed by cutting the recesses in a first plate member and with the recesses all disposed within a particular plane. By the same token, the line segments are all positioned within the recesses and lie within the particular plane. This simplifies the structure of the switch and substantially reduces the possibility of cross-talk.

The various line segments may be individually actuated using actuator pins to provide for the different positions of the switch. Specifically, each curved line segment 40, 42 and 44 include three actuator pins. Using segment 44 as an example, and as shown in FIGS. 5, 7 and 8, actuator pins 52, 54 and 56 are positioned to slide within openings 58, 60 and 62 in the cover plate 18. The actuator pins 52, 54 and 56 each include an enlarged end portion which fit within a complimentary enlarged portion of the openings in the cover plate 18. The actuator pins 52 and 56 include additional pin portions 64 and 66 extending from the enlarged end portions and with the pin portions received within openings in the line segment 44. The actuator pins 52, 54 and 56 are composed of insulating material.

The actuating system for the line segment 44 also includes a pair of spring-loaded insulating members 68 and 70. The spring-loaded insulating members include end pin portions 72 and 74 which are received within openings in the line segment 44. The insulating members 68 and 70 are positioned for sliding movement within openings 76 and 78 in the cavity plate 16 and with spring members 80 and 82 also disposed within the openings 76 and 78. End caps 84 and 86 hold the insulating members and spring members in position to provide force against the line segment 44 in a direction to maintain the line segment in the position shown in FIG. 8. An insulating support member 88 is fixed in position within opening 90 in the cavity plate 16 and extends within the cavity 24 to act as a stop. The support member 88 thereby controls the position of the line segment 44 when the line segment is moved to a central position within the cavity portion 24.

It can be seen that if force is applied to the actuating pins 52, 54 and 56 in a direction to move the line segment 44 out of contact with the plate cover 18 and with the force sufficient to overcome the spring force provided by the spring members 80 and 82, the line segment will move to a center position. In the center position, the ends of the line segment will contact and be supported by the inner conductors 34 and 36. The center of the line segment will be stopped by and supported by the insulating support member 88.

Figure 10:
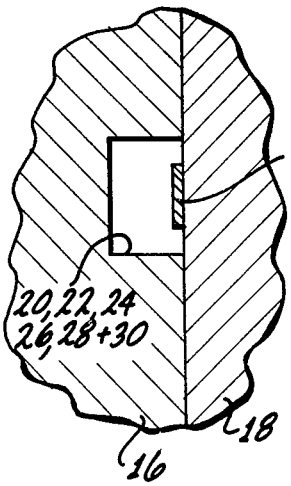
FIG. 10 illustrates a cross-sectional view of any cavity portion and with a line segment in shorted position.
Figure 11:
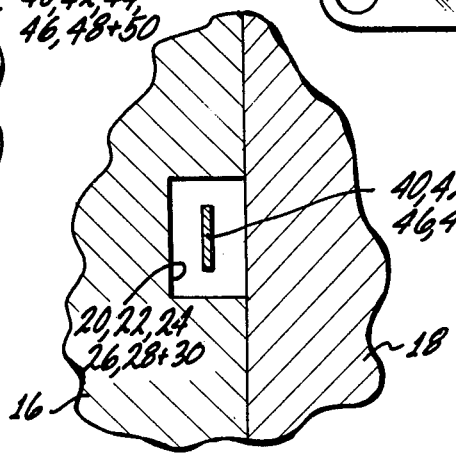
FIG. 11 illustrates a cross-sectional view of any cavity portion and with a line segment in position for passing an RF signal.

The movement of a line segment may be seen generally in FIGS. 10 and 11 which Figures are representative of any of the line segments. As can be seen in FIG. 10, the line segment contacts one wall of the cavity and therefore provides for no transfer of RF signals. In the position of the line segment shown in FIG. 11, the line segment is located within the center of the cavity. When the ends of the line segment contact the inner conductors of the coaxial cables, then RF energy is passed between the coaxial cables using the combination of the line segment and cavity portion to form a short coaxial line.

FIGS. 5, 6 and 7 illustrate the actuating mechanism used for the individual radial line segments 46, 48 and 50. The actuating mechanism used for radial line segment 48 is shown as an example for all three radial line segments. An insulating actuating pin 90 slides within an opening 92 in the cover plate 18. The actuating pin 90 includes an enlarged end and the opening 92 has a complimentary enlarged end. A small pin portion 94 is formed at the end of the actuating pin 90 and the pin portion 94 is received within an opening in the radial line segment 48.

A movable insulating member 96 is spring biased by a spring member 98 and both members are received within an opening 100 in the cavity plate 16. A plug member 102 retains the members 96 and 98 in position and provides for the insulating member 96 pushing the line segment 48 into the position shown in FIG. 6. A pair of insulating pins 104 and 106 shown in FIG. 7 engage the inner end of the radial line segment 48 and act as guides during the movement of the radial line segment. A third pin 108 is also included and the three pins in combinations provide for guiding the inner ends of the radial line segments 46, 48 and 50.

The movement of the radial line segment can be seen with reference to FIG. 6 and also with reference to FIGS. 10 and 11 which is representative of the movement of all of the line segments. When sufficient force is applied to the actuating pin 90 so as to overcome the spring force provided by the spring member 98 the line segment 48 is moved to a center position within the cavity portion 28. When in the center position, the ends of the radial line segment 48 are in contact with the inner conductors 36 and 38. This is generally represented by a movement of the line segment from the position shown in FIG. 10 to the position shown in FIG. 11. When the line segment 48 is in the center position as shown in FIG. 11 and its ends are in contact with the inner conductors 36 and 38, RF signals may be transferred between the coaxial connectors 3 and 4.

It can be seen, therefore, that movements of different pairs of line segments provide for the transfer of signals between different pairs of coaxial connectors. Specifically, position A as shown in FIG. 4 is produced by actuation of the line segments 46 and 44 to the center positions within the corresponding cavity portions 26 and 24. Position B is provided by actuation of the line segments 42 and 50 to the center positions within the corresponding cavity portions 22 and 30. Finally, position C is provided by actuation of the line segments 40 and 48 to the center positions within the corresponding cavity portions 20 and 28.

The present invention therefore provides for all possible switching positions between pairs of four coaxial connectors and with the structure disposed in a single plane. All of the cavity portions are formed in a single cavity plate and with all of the line segments disposed within the cavity portion in the single cavity plate. The structure of the coaxial switch of the present invention is therefore simpler than prior art switch and reduces the possibility of crosstalk.

Although the invention has been shown with reference to a particular embodiment it should be appreciated that various adaptations and modifications may be made and the invention is only to be limited by the appended claims.

I claim:

1. An RF transfer switch for providing all possible combinations between pairs of connectors in an array of four connectors, including an RF cavity disposed in a particular plane and formed by a plurality of cavity portions and including an outer circumferential portion and three radial portions each extending from a central intersecting position within the circumferential portion and intersecting the circumferential position at three spaced positions to subdivide the circumferential portion into three outer portions for forming a total of six cavity portions, four RF connectors coupled to the RF cavity and with three of the connectors each individually coupled to the cavity portions at an intersection between one of the radial portions and the circumferential portion and with the fourth connector coupled to the central intersecting position, and a plurality of six RF transfer means each located within one of the six cavity portions and with each transfer means individually movable between a first position for preventing transfer of RF energy between a pair of connectors and a second position for coupling RF energy between a pair of connectors and with the transfer means each located within the particular plane.

2. The RF transfer switch of claim 1 wherein the RF cavity is formed as recessed portions in a first plate and a second plate forming a cover for the recessed portions.

3. The RF transfer switch of claim 2 wherein the transfer means are formed as line segments each extending along the length of a corresponding cavity portion and with the line segments in the first position lying adjacent one wall of the cavity portions and in the second position lying in the middle of the cavity portions.

4. The RF transfer switch of claim 3 wherein the RF connectors are formed as coaxial connectors and with the coaxial connectors including inner conductors extending into the recessed portions and located at the intersections between the cavity portions and with each of the line segments in the second position having its ends in contact with a pair of the inner conductors.

5. The RF transfer switch of claim 1 wherein the circumferential portion is formed as a circle and the radial portions are formed as radii of the circle located 120° apart.

6. The RF transfer switch of claim 1 wherein the RF connectors are formed as coaxial connectors and with the coaxial connectors including inner conductors extending into the RF cavity and located at the intersections between the cavity portions.

7. A transfer switch for providing transfer of electrical signals between pairs of connectors in an array of four connectors, including a transfer structure disposed in a particular plane and formed by a plurality of transfer paths and including an outer circumferential portion formed by three linked portions and three radial portions each extending from a central position within the circumferential portion and each radial portion extending outwardly and intersecting the circumferential portion of the juncture of two linked portions, four connectors coupled to the transfer structure and with individual connectors coupled to the transfer structure at each intersection between a radial portion and two linked portions and with an individual connector coupled to the central position, and a plurality of transfer means individually coupled to the individual transfer paths and with each transfer means including a first position for preventing transfer of electrical signals between a pair of connectors and a second position for effecting a transfer of electrical signals between a pair of connectors.

8. The transfer switch of claim 7 wherein the transfer structure is a cavity having the transfer paths formed as recessed portions in a first plate and a second plate forming a cover for the recessed portions.

9. The transfer switch of claim 8 wherein the transfer means are formed as line segments each extending along the length of a corresponding recessed portion and with the line segments in the first position lying adjacent one wall of the recessed portions and in the second position lying in the middle of the recessed portions.

10. The transfer switch of claim 9 wherein the connectors are formed as coaxial connectors and with the coaxial connectors including inner conductors extending into the recessed portions and located at each intersection between a radial portion and two linked portions and at the central position and with each of the line segments in the second position having its ends in contact with a pair of the inner conductors.

11. The transfer switch of claim 7 wherein the outer circumferential portion is formed as a circle and the radial portions are formed as radii of the circle located 120° apart.

12. The transfer switch of claim 7 wherein the connectors are formed as coaxial connectors and with the coaxial connectors including inner conductors coupled to the transfer paths.

* * * * *